US005302261A

United States Patent [19]

LeRoy et al.

[11] Patent Number: 5,302,261

[45] Date of Patent: Apr. 12, 1994

[54] POWER ASSISTED DEZINCING OF GALVANIZED STEEL

[75] Inventors: Rodney L. LeRoy, Pointe-Claire; George Houlachi, Kirkland; M. Barakat I. Janjua, Pointe-Claire, all of Canada

[73] Assignee: Noranda Inc., Toronto, Canada

[21] Appl. No.: 107,178

[22] Filed: Aug. 17, 1993

Related U.S. Application Data

[63] Continuation of Ser. No. 827,627, Jan. 29, 1992, abandoned.

[30] Foreign Application Priority Data

Mar. 18, 1991 [CA] Canada ..... 2038537

[51] Int. Cl.[5] ..... C25F 5/00

[52] U.S. Cl. ..... 204/146; 204/116; 204/118

[58] Field of Search ..... 204/116, 118, 146

[56] References Cited

U.S. PATENT DOCUMENTS

| | | | |
|---|---|---|---|
| 700,563 | 5/1902 | Sadtler | 204/116 |
| 2,241,585 | 5/1941 | Day | 204/146 |
| 2,578,898 | 12/1951 | Orlik | 204/146 |
| 2,596,307 | 5/1952 | Stuffer | 204/146 |
| 3,394,063 | 7/1968 | Blume | 204/146 |
| 3,492,219 | 1/1970 | Bowers, et al. | 204/146 |
| 3,619,390 | 11/1971 | Dillenberg | 204/146 |
| 3,634,217 | 1/1972 | Bedi, et al. | 204/146 |
| 3,649,491 | 3/1972 | Bowers, et al. | 204/146 |
| 3,959,099 | 5/1976 | Froman et al. | 204/146 |
| 5,106,467 | 4/1992 | Leeker et al. | 204/114 |

FOREIGN PATENT DOCUMENTS

| | | |
|---|---|---|
| 659141 | 3/1963 | Canada . |
| 870178 | 5/1971 | Canada . |
| 8402924 | 9/1984 | Netherlands . |

OTHER PUBLICATIONS

Janjua et al., "Electrocatalyst Performance in Industrial Water Electrolysers" Int. J. Hydrogen Energy, vol. 10, No. 1, (1985).

An Announcement by P. Scolieri in "Amer. Metal Market" dated Apr. 18, 1990, p. 3.

"MRI Attempts to Dezinc Scrap", Amer. Metal Mkt.-Nov. 26, 1990, p. 4 A. Wrigley.

*Primary Examiner*—John Niebling
*Assistant Examiner*—Arun S. Phasge
*Attorney, Agent, or Firm*—Keck, Mahin & Cate

[57] ABSTRACT

A method of removing zinc from galvanized steel, comprises immersing the galvanized steel in a caustic electrolyte solution, electrically connecting the steel to the positive terminals of a source of direct current, and electrically connecting the negative terminals of the current source to a cathode material which is stable in caustic electrolyte and has a low hydrogen overvoltage.

8 Claims, 2 Drawing Sheets

POWER ASSISTED DEZINCING OF GALVANIZED STEEL

This is a continuation application of U.S. patent application Ser. No. 07/827,627 filed on Jan. 29, 1992, now abandoned.

This invention relates to a method of removing zinc from galvanized steel.

Over half of North American zinc shipments are used for the production of galvanized steel. There is a significant scrap rate in mills producing galvanized sheet, this being as high as 15 to 20% or more, and the scrap rate in the plants of primary fabricators of galvanized sheet can be even higher, 25% or more. Thus, over one million tons of fresh galvanized scrap are produced each year.

Galvanized scrap is normally purchased by steel mills at a substantial discount to non-galvanized material. This discount is necessary because the galvanized scrap must be fed to melting furnaces where the zinc vaporizes and is trapped in the flue dust, with the result that this flue dust cannot be easily sold or returned to the furnace. Further, there are now increasing environmental constraints on disposal of zinc containing dusts as land-fill. Also, feeding excessive amounts of galvanized scrap to basic oxygen steel making furnaces (BOF) can result in costly shut-downs for cleaning and for refractory repair.

Thus, there is great interest in development of an economical method of removing zinc from galvanized scrap. Although no process has been transferred as of now to successful commercial practice, at least seven approaches have been described previously; these are detailed by M.B.I. Janjua and R.L. LeRoy ("Galvanic Dezincing of Galvanized Steel., Canadian Patent Application 2,027,656 filed Oct. 15, 1990). Five of these approaches have enjoyed extensive development and testing, but have been abandoned in terms of practical commercial application: dissolution of zinc with pickle liquor; dissolution of zinc with ammonium carbonate solution; dissolution of zinc with caustic soda; recovery of zinc as zinc chloride; and acceleration of zinc removal in caustic electrolyte through the addition of oxidizing agents.

The sixth approach has promise for commercial dezincing of galvanized scrap; it is power-assisted removal of zinc in caustic electrolyte. In this approach, an external source of voltage is applied to the metal-coated scrap to force the passage of current from it to a counter electrode. The coating metal is thus dissolved anodically at the positive electrode and, at least in part, deposited on the negative electrode. Numerous patents describe methods of this type, including Canadian patent 870,178 and U.S. Pat. Nos. 2,578,898, 2,596,307, 3,394,063, 3,492,210, 3,619,390, 3,634,217, and 3,649,491. A recent announcement in American Metal Markets, Apr. 18, 1990, page 3, and a further description in American Metal Markets, Nov. 26, 1990, page 4, describe piloting of a process of this type in which zinc has been removed from bundles of galvanized steel of four types: hot dipped; electrogalvanized; galvalume; and galvannealed. While this method is more practical than those referenced above, it suffers from two major problems. First, costly electric power must be used to strip the zinc from the galvanized steel. At typical power rates this cost can be on the order of $10 to $15 per ton of scrap. Also, rectifiers, conductors, breakers and related equipment add significantly to the installed cost of a dezincing facility. Secondly and more serious, dissolved zinc, iron and other impurities deposit, at least in part, directly on the cathodes which are used to promote electrolytic dissolution. The resulting deposits are impure, reducing their economic value and limiting options for further purification and recycling of the zinc. This second problem, however, relates to only a portion of the zinc which is dissolved; the cathodic deposition process is inefficient, and zinc deposition occurs in parallel with the evolution of hydrogen. Typically, 30 to 60% of the current is carried by zinc deposition. The balance of the zinc accumulates in the electrolyte, from which a stream can be removed for purification and subsequent zinc recovery.

The seventh approach is that described by Janjua and LeRoy in Canadian Patent Application 2,027,656 filed Oct. 15, 1990. This process is also electrochemical, and it achieves dezincing without the application of external current. In essence, this is effected by bringing the zinc-coated steel into electrical contact with a cathode material which is stable in caustic electrolyte and exhibits a very low hydrogen overvoltage. Several cathode materials suitable for such application are identified in the referenced patent application. This method overcomes both of the problems associated with power-assisted removal of zinc. First, as no external source of current is required, no costs are incurred for electric power or for the associated rectifiers, conductors and related power conditioning system. Secondly, it is thermodynamically impossible in this method for zinc to deposit on the low-overvoltage cathode; all of the dissolved zinc remains in the electrolyte. This makes it possible to use the method in a continuous process in which zinc bearing electrolyte is drawn off from the dissolution vessel for purification and zinc recovery.

The galvanic process just described is best suited to zinc removal from clean, unpainted scrap, and in particular to scrap which has been shredded. This is because the potential available to drive galvanic dissolution is typically on the order of 550 millivolts, so the geometry of the dissolution equipment must be such that the distance between the galvanized scrap and the cathode material is kept to a minimum. Otherwise, much of the available voltage will be consumed by resistive heating of the electrolyte, and the maximum current—and thus the rate of zinc dissolution—will be low. This limitation is particularly important when bundles of steel scrap are to be dezinced. In this case, the electrolyte path between the point of anodic zinc dissolution and the corresponding hydrogen evolution on the cathode can be long and tortuous. With scrap of this type, applied voltages of several volts are typically required to achieve economic rates of zinc stripping.

The object of the present invention is to allow the dissolution of zinc with current applied from an external power supply, without the corresponding cathodic deposition of zinc on the cathode. It has surprisingly been found that this can be achieved by using as cathodes suitable materials having very low hydrogen overvoltages. This makes possible the recovery of zinc from the electrolyte in a further and separate step of a continuous process, following suitable purification.

The potential at which zinc will deposit on a cathode material, $E_{Zn}$, is a function of the pH of the caustic electrolyte, of its temperature (T, in degrees Kelvin), and of the concentration of zinc in solution as zincate ions ($ZnO_2^{--}$), according to the following equation (from M. Pourbaix, "Atlas of Electrochemical Equilibria", National Association of Corrosion Engineers, Houston, 1974, p. 409): $E_{Zn}=0.441=0.1182\,(T/298)pH+0.0295\,(T/298)\log[ZnO_{2-}]$.

This potential may be compared with the thermodynamic potential at which hydrogen evolution can occur:

$$E_H=-0.0591\,(T/298)\,pH.$$

The difference between these two expressions is the value of the hydrogen overvoltage above which zinc will deposit; it is on the order of 550 millivolts. Thus, if a cathode material is used on which hydrogen will evolve at an overvoltage much lower than this value, then no zinc will deposit and the only cathodic reaction will be the evolution of hydrogen.

The cathodes which may be effectively used in this invention are the same class of materials which can be economically used in the alkaline electrolysis of water, as described for example by Janjua and LeRoy in "Electrocatalyst Performance in Industrial Water Electrolysers", Int. J. Hydrogen Energy, Vol. 10, No. 1, pp. 11-19, 1985, and by Bowen et al. in "Developments in Advanced Alkaline Water Electrolysis", Int. J. Hydrogen Energy, Vol. 9, No. 12, pp. 59-66, 1984. The active cobalt cathode material described by Janjua and LeRoy in U.S. Pat. No. 4,183,790 has also proven effective in short term tests, although it loses activity on long-term use. The most successful cathode materials for long-term commercial use are high-surface area nickel-based materials, for example of the Raney nickel type. High surface-area cobalt-based materials, for example of the Raney cobalt type, may also be used. Other suitable cathode materials are nickel molybdates, nickel sulfides, nickel-cobalt thiospinels and mixed sulfides, nickel aluminum and nickel zinc alloys, and electroplated active cobalt compositions.

BRIEF DESCRIPTION OF THE DRAWINGS

The invention will now be disclosed, by way of example, with reference to the following examples which refer to accompanying drawings in which.

The following three examples demonstrate the essential features of this invention.

Figure 1:
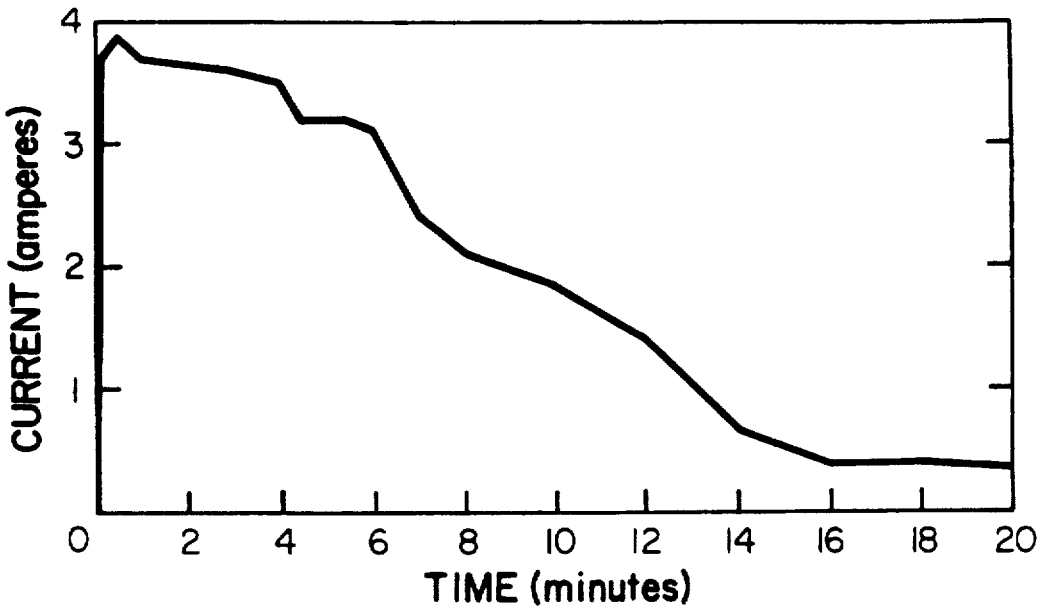
FIG. 1 illustrates the current flow versus time when a voltage of 1.4 volt was applied between a piece of galvannealed steel and a Raney-nickel type active cathode immersed in a caustic electrolyte.

In a first example, a solution was prepared containing 40 grams per litre of zinc as sodium zincate together with 250 grams per litre of sodium hydroxide. A direct current was passed between a piece of galvannealed steel (immersed area 5-cm × 13-cm; zinc coating approximately one percent by weight) and a Raney-nickel-type active cathode (material NE-C-200 described in Int. J. Hydrogen Energy, Vol. 10, No. 1, pp. 11-19, 1985). Spacing between the steel anode and the active cathode was about 10 cm., and the electrolyte was maintained at 42° C. A constant voltage of 1.4 Volts was applied from an external power supply, and the current measurements summarized in FIG. 1 were recorded.

Vigorous evolution of hydrogen was observed on the cathode, while no gas was observed on the anode. The rate of hydrogen evolution decreased with time through the experiment, dropping to a low level by the end of 20 minutes. The current dropped steadily over the 20 minute period, with a total of 2,270 coulombs of charge being passed. This corresponds to dissolution of 0.77 grams of zinc, in approximate agreement with the original zinc loading of the immersed steel. No zinc deposited on the active cathode material. The steel anode was completely black at the end of the experiment, showing no evidence of residual zinc. The zinc coating had been completely dissolved in the electrolyte.

Figure 2:
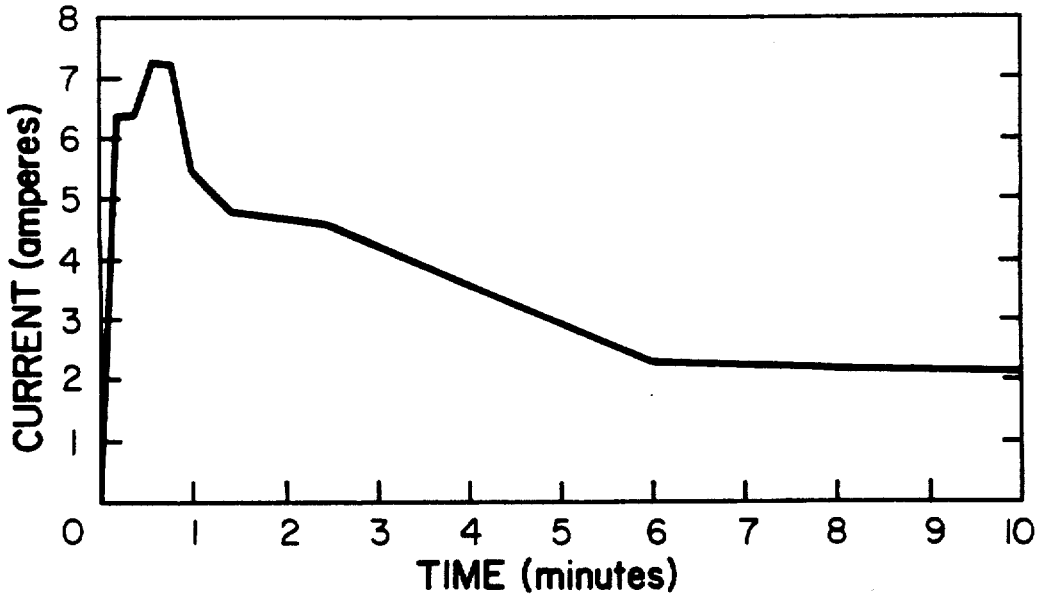
FIG. 2 illustrates the current flow versus time when a higher voltage of 2.5 volts was applied between a piece of galvannealed steel and a Raney-nickel type active cathode immersed in a caustic electrolyte.

In a second example, an identical galvannealed steel cathode was used in the same experimental set-up as example 1. In this case the voltage applied to the cell was much higher, 2.5 Volts. The resulting current flow is recorded in FIG. 2. Reflecting the higher driving force, the current rose to over seven amperes before decreasing steadily over a ten minute period. During this process, vigorous evolution of hydrogen was observed on the cathode, together with steady but much less vigorous oxygen evolution on the anode. This is simply indicative of the high cell voltage, which is sufficient to decompose water. Much of the residual current after ten minutes was due to this electrolysis, as the zinc coating on the steel was observed to be largely removed by this point. Further, a pinkish-violet color was observed coming from the anode after about eight minutes, indicative of iron dissolution as the ferrate ion ($FeO_{4-}$).

There was no deposition of zinc or of any other material on the active cathode during this process, demonstrating that the zinc stripped from the anode had been dissolved in the electrolyte. The electrolyte remained clear. Integration of the current flow of FIG. 2 indicates a total charge transferred of 2015 coulombs by ten minutes, corresponding to dissolution of 0.68 grams of zinc. Comparison with the zinc dissolution in example 1 suggests that this process was somewhat over 80% complete when the experiment was terminated.

In a third example, 32 coupons roughly 3.1-cm by 1.5-cm in size were sheared from a sheet of hot-dipped galvanized steel bearing approximately 2.3% by weight of zinc. The coupons were mounted in a rectangular mesh basket fabricated from nickel wire, and this basket was immersed in the same caustic soda electrolyte used in examples 1 and 2, containing 40 grams per litre of zinc as sodium zincate and 250 grams per litre of sodium hydroxide. The electrolyte was maintained at a temperature of 42° C. The basket was located approximately 5 cm from a Raney-nickel cathode of the type described in example 1 above, and a constant direct current of 3.4 amperes was passed between the basket (anodic) and the cathodes.

Figure 3:
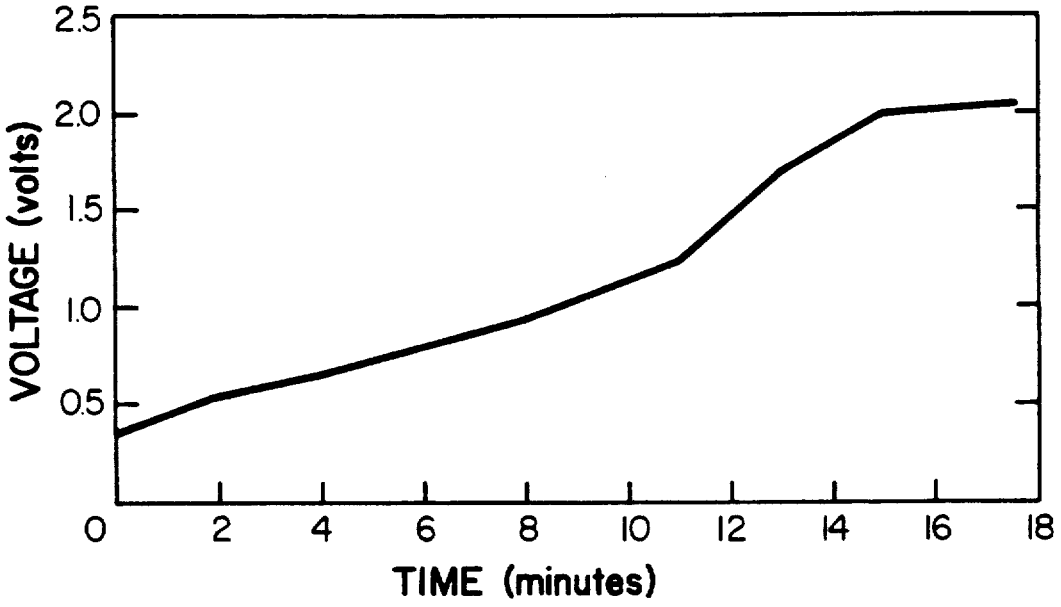
FIG. 3 illustrates the voltage rise versus time when a constant direct current of 3.4 amperes was applied between a basket containing coupons of hot-dipped galvanized steel and a Raney-nickel type active cathode immersed in a caustic electrolyte.

The experiment was continued for 18 minutes, and the voltage on the cell rose steadily over this period as shown in FIG. 3. Hydrogen was observed to evolve vigorously on the cathode throughout the process, while oxygen was observed on the anodic coupons after 14 minutes, as the voltage on the cell rose towards 2 Volts. After this time the visible surfaces of the galvanized coupons were observed to have become black, largely devoid of zinc. Total charge transferred during the 18 minutes of the experiment was 3670 coulombs, corresponding to dissolution of 1.24 grams of zinc. To compare, the weight difference of the steel coupons before and after the experiment was 1.3 grams. There was no zinc deposited on the active cathode during this experiment.

This invention is of course not limited in any way to the conditions of the examples described above. For example, the examples have been carried out in a batchwise fashion. While the process can be useful in this mode of operation, it would normally be practiced in a continuous manner, with solution being continuously passed from a tank in which zinc is being removed from galvanized steel by the method of this invention to a tank in which zinc is being electrowon or otherwise recovered from the zincate solution. Methods of electrowinning zinc from zincate solutions are well known in the art, as described for example by C.C. Merrill and R.S. Lang in "Experimental Caustic Leaching of Oxidized Zinc Ores and Minerals and the Recovery of Zinc from Leach Solutions", U.S. Bureau of Mines Report of Investigations No. 6576, April 1964. In this way the method of this invention may be performed with the zincate level being held at an approximately constant level. This also allows the invention to be practiced with little net consumption of caustic.

Cell voltage in this method depends directly on the experimental arrangement. Zinc dissolution will proceed for any voltage value significantly greater than zero. For typical arrangements, voltages in excess of 2 volts will be required to give optimum rates, and this value can be much higher if the geometric spacing is great or there are other sources of resistive losses in the system.

It is clear that this method could be practiced in a wide range of electrolytes having pH values between 11 and 15.5. Sodium hydroxide and potassium hydroxide are the most suitable candidate electrolyte materials, because of their ready availability and low cost.

Many geometric arrangements can be envisaged within the scope of this invention. As disclosed in the examples above, the hydrogen evolving cathode material may be mounted in the dissolution tank in proximity to the galvanized steel being dezinced. Alternatively, the low-overvoltage cathode material could be mounted in a separate chamber formed at least in part by a low-resistivity separator which is stable in caustic electrolyte, suitable examples being woven asbestos cloth or felted polyphenylene sulfide cloth. Such an arrangement would allow collection of the hydrogen evolved in a pure form, thus isolating it for safety reasons from any oxgyen evolved on the anode and allowing recovery of its economic value. Further, such an arrangement would minimize damage to the cathode material from possible contact with the steel being dezinced, or from impurities entrained with that steel.

We claim:

1. A method of removing zinc from galvanized steel without significant cathodic deposition of zinc on the cathode, comprising immersing the galvanized steel in a caustic electrolyte solution selected from caustic soda solution and caustic potash solution at a pH between 11 and 15.5, electrically connecting the steel to the positive terminals of a source of direct current, and electrically connecting the negative terminals of the current source to a cathode material which is stable in caustic electrolyte and has a low hydrogen overvoltage.

2. A method as defined in claim 1, where the cathode is a material exhibiting a hydrogen overvoltage, at current densities on the order of 100 milliamperes per square centimeter of less than 150 millivolts, said material being selected from the materials including Raney nickels and other very high surface area nickel materials and very high surface area nickelalloys, Raney cobalts and other very high surface area cobalt materials and very high surface cobalt alloys, nickel molybdates, nickel sulfides, nickel-cobalt thiospinels and mixed sulfides, and electroplated active cobalt compositions.

3. A method as defined in claim 2 wherein the hydrogen overvoltage is less than 100 millivolts.

4. A method as defined in claim 1 where the electrolyte temperature is between 15° C. and 80° C.

5. A method as defined in claim 1 where zinc ion concentration in the caustic electrolyte is maintained between zero and 50 grams per liter.

6. A method as defined in claim 1, where zinc is subsequently recovered from the electrolyte solution by electrowinning.

7. A method as defined in claim 6, where the zinc is removed from galvanized steel to an electrolyte solution in a dezincing step, zinc is stripped from the electrolyte solution in an electrowinning step, and the electrolyte is returned to the dezincing step, so that there is little net consumption of caustic.

8. A method as defined in claim 1, in which the low overvoltage cathode material is contained within a chamber formed at least in part by a low resistivity separator material which is stable in caustic electrolyte, thus allowing the hydrogen produced on said cathode material to be recovered for safe disposal, use or sale.

* * * * *